US009072952B2

(12) United States Patent
Chu et al.

(10) Patent No.: US 9,072,952 B2
(45) **Date of Patent: *Jul. 7, 2015**

(54) GOLF PUTTER GRIP

(71) Applicants: Hong-Sung Chu, Alhambra, CA (US); Chiung-Ling Wang Chu, Alhambra, CA (US); Leo Jaw, Taichung (TW)

(72) Inventors: Hong-Sung Chu, Alhambra, CA (US); Chiung-Ling Wang Chu, Alhambra, CA (US); Leo Jaw, Taichung (TW)

( * ) Notice: Subject to any disclaimer, the term of this patent is extended or adjusted under 35 U.S.C. 154(b) by 136 days.

This patent is subject to a terminal disclaimer.

(21) Appl. No.: 13/815,091

(22) Filed: Jan. 30, 2013

(65) Prior Publication Data

US 2014/0213385 A1 Jul. 31, 2014

(51) Int. Cl.

| | |
|---|---|
| ***A63B 53/14*** | (2006.01) |
| ***A63B 59/00*** | (2015.01) |
| *A63B 53/04* | (2015.01) |

(52) U.S. Cl.

CPC ..... *A63B 53/14* (2013.01); *A63B 59/0025* (2013.01); *A63B 53/0487* (2013.01)

(58) Field of Classification Search

CPC . A63B 53/14; A63B 53/0487; A63B 59/0025
USPC ..... 473/300–303
See application file for complete search history.

(56) References Cited

U.S. PATENT DOCUMENTS

| | | | | |
|---|---|---|---|---|
| 3,837,647 | A * | 9/1974 | Jacques | 473/300 |
| 4,067,573 | A * | 1/1978 | Key, Jr. | 473/201 |
| 5,906,548 | A * | 5/1999 | Hadge | 473/206 |
| 6,213,891 | B1 * | 4/2001 | Moore | 473/300 |
| 6,626,768 | B2 | 9/2003 | Roelke | |
| 6,890,265 | B2 * | 5/2005 | Enlow | 473/201 |
| 6,902,492 | B1 * | 6/2005 | Strand | 473/201 |
| 7,175,538 | B2 | 2/2007 | Miller | |
| 7,435,186 | B1 * | 10/2008 | Miller | 473/300 |
| 7,658,684 | B2 * | 2/2010 | Ferris | 473/300 |
| 8,858,356 | B2 * | 10/2014 | Chu et al. | 473/300 |
| 2004/0198529 | A1 * | 10/2004 | Moore | 473/296 |
| 2007/0219015 | A1 * | 9/2007 | Gazeley | 473/300 |
| 2013/0203514 | A1 * | 8/2013 | Chu et al. | 473/203 |
| 2014/0200097 | A1 * | 7/2014 | Chu et al. | 473/303 |

* cited by examiner

*Primary Examiner* — Stephen Blau

(57) ABSTRACT

A golf putter grip comprises a main tubular body having a non-circular cross-section being symmetrical and remaining similar throughout its axial length, and a flat front area being also along and throughout its axial length. The non-circular cross-section and the flat front area respectively have a width sufficient to have two hands cupped together at the same height and two thumbs placed side by side on the flat front area to hold the putter grip comfortably with minimal wrist breaking-down. The main tubular body preferably has flat-topped arch cross-section and is reversely tapered, and its reverse taper is sufficient in certain degrees to accommodate different finger lengths of two hands for reducing the gripping pressure, so as to make the gripping comfortable.

10 Claims, 9 Drawing Sheets

GOLF PUTTER GRIP

BACKGROUND OF THE INVENTION

1. Field of the Invention

The invention is related to a golf putter grip that has an improved shape or configuration capable of reducing the gripping pressure and minimizing the wrist breaking-down, whereby it is able to enhance a pendulum-type putting stroke of golf players, to make the grip comfortable to hold, and to putt the ball more accurately and have better distance and direction control.

2. Background of the Invention

Putting stroke is very important for the golf players to putt the ball into the hole at the putting green. A pendulum-type putting stroke has been used by the golf players to have square impact with the ball in the intended line of ball rolling and better direction and distance control. In order to make this type of stroke, the golf players at addressing the ball should have their shoulder on the same level, both hands cupped together to hold a golf putter grip downwardly at the same height, both thumbs placed side by side on a flat front portion of the golf putter grip, and other fingers beside the thumbs placed around the body of the golf putter grip. The shoulder, the arms and the cupped hands holding the golf putter grip together form a triangle frame to move the golf putter in the way of pendulum to strike the ball stably and consistently in their intended direction and distance.

There are some prior arts disclosing a golf putter grip with an improved gripping body shape for this type putting stroke. In a U.S. patent with application Ser. No. 10/594,129 as shown in FIGS. 1~1A, Gazeley disclosed a putter grip including a gripping body having a wide portion of substantially uniform and substantially rectangular cross section. The wide portion is of sufficient width to allow two hands to hold at the same height. In another U.S. patent with Pat. No. 6,902,492, as shown in FIGS. 2~2A, Strand disclosed a putter grip including a hollow tapered body having a modified rectangular cross section. The body has an upper and an intermediate portions, in combination, extending at least 60% of the body length from its second closed end and having a width dimension to depth dimension ratio of at least 1.1:1.

A human hand consists of a broad palm PM and five digits and is attached to the forearm by a joint called the wrist TW, as shown in FIG. 3. The lengths of Index fingers DX and middle fingers MD (between the fingertip and the palm) are longer than that of small fingers PK. When two hands are cupped together at the same height with both thumbs placed side by side to hold a conventional golf putter single grip downwardly, the area held by middle fingers MD and palms PM is towards a bottom open end of the golf putter grip and should be larger in dimension than the dimension of the area held by the small fingers PK and the palms PM towards a top cap end of the golf putter grip in order to make the grip comfortable to hold and reduce the gripping pressure. If the shape of the single grip's gripping body of a conventional golf putter does not accommodate the fingers (middle fingers MD and small fingers PK) with different finger lengths, the golf players need to grip the conventional putter single grip more tightly in order to hold it firmly. Thus, the single grip's gripping body of the conventional golf putter for the pendulum-type putting stroke is better to be reversely tapered in shape from the top cap end towards the bottom open end of the conventional golf putter single grip, and its reverse taper should be sufficient in certain degrees to accommodate the fingers (small and middle fingers) with different finger lengths for making the grip comfortable to hold and reducing the gripping pressure. These certain degrees should conform to what is regulated in "the Rules of Golf" published by U.S.G.A. (United States Golf Association).

Moreover, some golf players prefer to stretch and rest their index fingers at a portion of the putter grip close to its bottom open end for their pendulum-type putting stroke. This also should be taken into consideration to improve the golf putter grip.

SUMMARY OF THE INVENTION

The Applicants have developed the present invention to solve the above problems.

It is an object of the present invention to provide an improved golf putter grip that has a hollow and reversely tapered gripping body and a sufficient reverse taper of the gripping body from the top cap end towards the bottom open end of the golf putter grip to make the golf payers' gripping comfortable for the pendulum-type putting stroke and to reduce the gripping pressure.

It is another object of the present invention to provide an improved golf putter grip, where the gripping body has a sufficient width and a flat front area of sufficient size to have two hands cupped together at the same height and both thumbs placed side by side on the flat font area to make the golf payers' gripping comfortable for the pendulum-type putting stroke and to minimize wrist breaking-down.

It is another object of the present invention to provide an improved golf putter grip, where the gripping body has a lower (extended) portion to for golf players to stretch and rest their index fingers for pendulum-type putting stroke.

It is still another object of the present invention to provide an improved golf putter grip that has non-circular cross-sectional dimensions measured in any direction no more than 1.75 inches (44.45 mm) to conform to "the Rules of Golf" published by U.S.G.A.

In order to achieve the above four objects, the present invention provides an improved golf putter grip with an overall length from 7 inches (177.8 mm) to 21 inches (533.4 mm) comprising: a top cap portion, a bottom open end, a main tubular body between the top cap portion and the bottom open end, a hollow lower portion extended between the main tubular body and the bottom open end. A rear bigger portion of a golf putter's shaft (not shown) can be inserted into the improved golf putter grip through the bottom open end up to the top cap portion. The top cap portion has a top end enclosed with a vent hole. The main tubular body has a cavity to envelope the rear bigger end of the golf putter's shaft, a non-circular cross-section that is symmetrical and remains similar throughout an axial length of the main tubular body, a non-circular cross-sectional width dimension in a range from 44.45 mm to 29.63 mm and perpendicularly along the axial length of the main tubular body, and a first flat front area having a widest portion in a width range from 42.45 mm to 20 mm and being also perpendicularly along and throughout the axial length of the main tubular body. Thereby, the golf putter grip's main tubular body of the present invention can provide a sufficient space for two hands being cupped together at the same height and for both thumbs being placed side by side on the first flat front area to hold the golf putter grip comfortably with minimal wrist breaking-down. The non-circular cross-section is preferably a flat-topped arch cross-section. The main tubular body is reversely tapered from the top cap portion towards the bottom open end. The non-circular cross-sectional depth dimension is defined to be the maximum vertical dimension from the first flat front area to a bottom of the non-circular cross-section along the axial length of the main tubular body. This non-circular cross-sectional depth dimension is in a range from 44.45 mm to 23.09 mm. The non-circular cross-section includes a first non-circular cross-section and a second non-circular cross-section. The first non-circular cross-section has the longest depth dimension in the main tubular body and is from a position that is within 30% of the overall length of the golf putter grip to a position which is one inch (including one inch that is 25.4 mm) from the bottom open end. The second non-circular cross-section has the shortest depth dimension in the main tubular body and is towards a position within one inch (25.4 mm) from the top end of the golf putter grip. The depth dimension of the first non-circular cross-section is longer than the depth dimension of the second non-circular cross-section in a ratio of 1.12:1 to 1.75:1. The hollow lower portion has a second flat front area extended from a bottom edge of the first flat front area of the main tubular body and to a position within one inch (25.4 mm) from the bottom open end, a non-reversely tapered body shape extended from the main tubular body towards the bottom open end, and a second downward body extended from a first downward body of the main tubular body for golf players to stretch and rest their index fingers thereon.

Owing to above mentioned reversely tapered shape of the main tubular body and its sufficient reverse taper, the golf putter grip for the pendulum-type putting stroke of the present invention can, within certain degrees, accommodate the fingers (small and middle fingers) with different finger lengths to hold the golf putter grip comfortably with less gripping pressure. And the non-circular cross-sectional width and depth dimensions of the golf putter grip are no more than 1.75 inches (44.45 mm) in order to conform to "the Rules of Golf" published by U.S.G.A.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
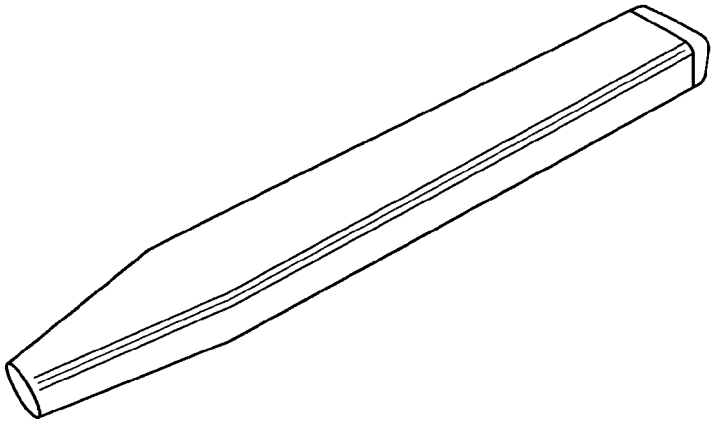
FIG. 1 (PRIOR ART)
FIGS. 1~1A are diagrams illustrating a prior art of U.S. patent with application Ser. No. 10/594,192.
Figure 1A:
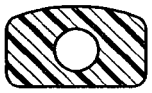
FIG. 1A (PRIOR ART)
Figure 2:
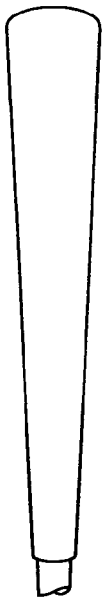
FIG. 2 (PRIOR ART)
FIGS. 2~2A are diagrams illustrating a prior art of U.S. patent with Pat. No. 6,902,492.
Figure 2A:
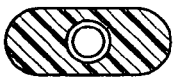
FIG. 2A (PRIOR ART)
Figure 3:
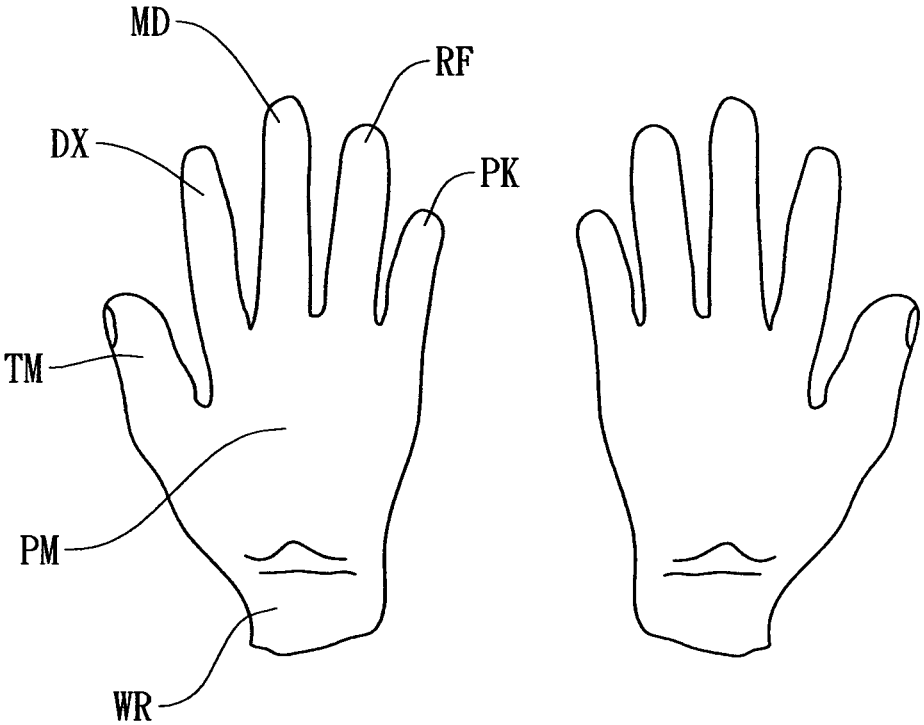
FIG. 3 is a diagram showing human hands with five digits.

The present invention will be illustrated from FIGS. 4 to 14, wherein the same elements are represented with the same reference number.

A golf putter grip of the present invention can be made of suitable rigid materials such as wood, light metal, natural cork, rubber, rubber compound, or plastic such as TPR (thermoplastic rubber), TPE (Thermoplastic Elastomer), closed-cell foams, closed-cell polyurethane (PU) foam, closed-cell ethylene vinyl acetate (EVA) foam, and closed-cell polyethylene (PE) foam. At least a portion of an outer surface of a main tubular body of the golf putter grip of the present invention can be covered with an anti-slip gripping materials such as rubber, rubber compound, plastics, natural leather, leather/foam materials, synthetic leather, wet-process Polyurethane (PU) leather, dry-process Polyurethane (PU) leather, Polyurethane/foam leather, and fabric and textile materials. These anti-slip gripping materials can be either in a single sheet form or in a strip form.

The above-mentioned materials and surface features are omitted in the drawings of the present invention in order to concentrate on the configuration in shape of the golf putter grip of the present invention.

Referring to FIGS. 4 to 8, a golf putter grip A is illustrated as a first embodiment of the present invention. The overall length of the golf putter grip A is in a range from 7 inches (177.8 mm) to 21 inches (533.4 mm). The overall length hereof is defined to be a length from a vent hole 22 to a bottom open end 31 of the golf putter grip A.

Figure 4:
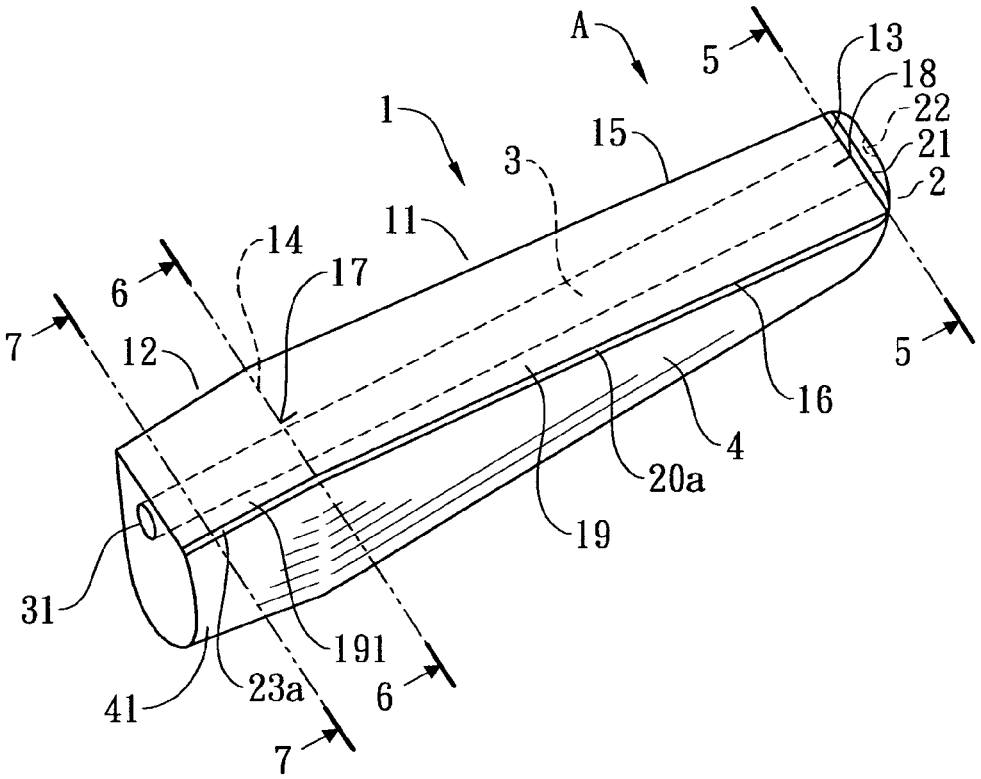
FIG. 4 is a perspective view showing a first embodiment of the present invention.

Referring to FIG. 4, the golf putter grip A has a top cap portion 2, the bottom open end 31, and a tubular body 1. The top cap portion 2 has a top end 21 enclosed with the vent hole 22. The top end 21 hereof is defined to be an end at an upper edge of the top cap portion 2 close to the vent hole 22. If the top cap portion 2 has no upper edge and is curved in shape toward the vent hole 22, then the edge of the vent hole 22 is defined as the top end 21. The tubular body 1 extends from the top cap portion 2 to the bottom open end 31. A rear bigger end of a golf putter's shaft (not shown) can be inserted through the bottom open end 31 into the tubular body 1 up to the top cap portion 2 (shown in FIGS. 4 and 8).

The tubular body 1 has a main tubular body 11 and a hollow lower portion 12. The main tubular body 11 has a top edge 13 extended to a position within one inch (25.4 mm) from the top end 21 and a hypothetical (or imaginary) bottom edge 14 located in a range from a position which is within 30% of the overall length of the golf putter grip A to a position which is one inch (including one inch that is 25.4 mm) from the bottom open end 31. The main tubular body 11 extends from the top cap portion 2 to the hollow lower portion 12.

Figure 5:
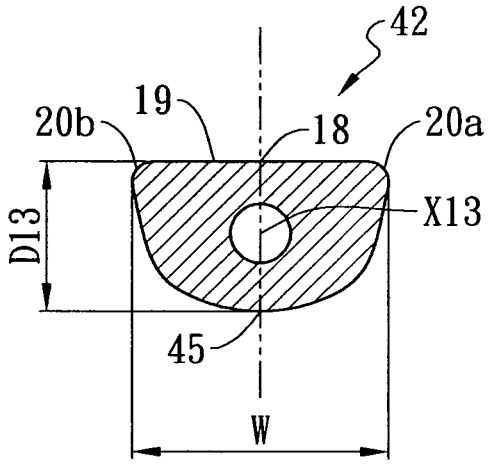
FIG. 5 is a cross sectional view showing a second non-circular cross-section of a main tubular body in the first embodiment of the present invention taken on line 5-5 of FIG. 4.
Figure 6:
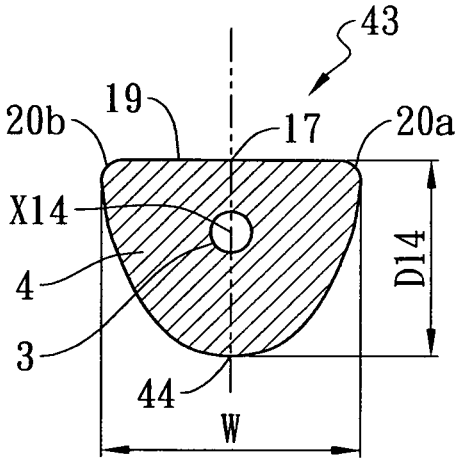
FIG. 6 is a cross sectional view showing a first non-circular cross-section of the main tubular body in the first embodiment of the present invention taken on line 6-6 of FIG. 4.

The main tubular body 11 further has a first flat front area 19 that is along and throughout an axial length of the main tubular body 11 and between the top edge 13 and the hypothetical (imaginary) bottom edge 14, a non-circular cross-section that is symmetrical and remains similar between the top cap portion 2 and the hollow lower portion 12 throughout the axial length of the main tubular body 11, and a first downward body 4 having a cavity 3 to envelope the rear bigger end of the golf putter shaft (not shown). The size or dimension of the non-circular cross-section is gradually reduced from the hypothetical (imaginary) bottom edge 14 to the top edge 13. As shown in FIGS. 4~6, the first downward body 4 is connected with the first flat front area 19 by means of a pair of curves 20*a*, 20*b* forming smoothly rounded shoulders along the axial length of the main tubular body 11.

When two hands cup together at the same height to hold the golf putter grip A for the pendulum-type putting stroke, two thumbs can be placed side by side on the first flat front area 19 and other fingers (beside index fingers DX) be placed around the first downward body 4.

Referring again to FIG. 4, the first flat front area 19 prefers to be in a shape of trapezoid or rectangular, more preferably in a rectangular shape. Its top edge 13 is extended up to a position within one inch (25.4 mm) from the top end 21 while its hypothetical (or imaginary) bottom edge 14 is located in a range from a position which is within 30% of the overall length of the golf putter grip A to a position which is one inch (including one inch that is 25.4 mm) from the bottom open end 31. A widest portion of the first flat front area 19 is in a width range from 42.45 mm to 20 mm and is perpendicular to the axial length of the main tubular body 11. Its two edges 13,14 respectively interconnect to two axial edges 15, 16 and respectively have a central mark 18, 17. The two axial edges 15, 16 are equal in length.

The surface of the first flat front area 19 can be planar or slightly convex. It is preferably planar. The planar surface of the first flat front area 19 is helpful for the golf players or grip installers to ensure that the golf putter grip A is properly installed by positioning the planar surface of first flat front area 19 to be perpendicular to a club head face of the golf putter.

Referring to FIGS. 5~6, the non-circular cross-section of the main tubular body 11 can be in a shape of triangular, rectangular or flat-topped arch. It is preferably in a flat-topped arch shape.

Figure 8:
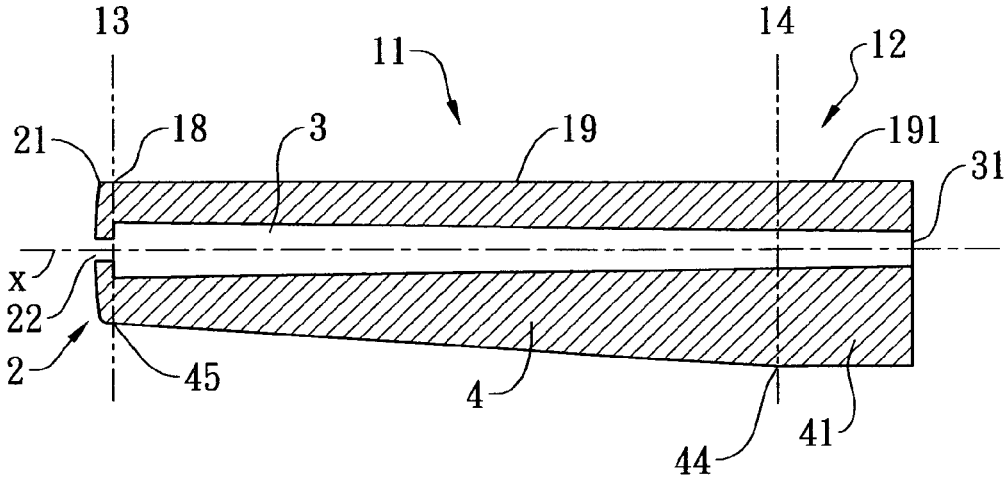
FIG. 8 is a longitudinal sectional view along a central part of the first embodiment of the present invention.

A non-circular cross-sectional width dimension W is defined to be the maximum dimension between the two outmost edges of the non-circular cross-section perpendicularly along the axial length of the main tubular body 11 and in a range from 44.45 mm to 29.63 mm. A non-circular cross-sectional depth dimension is defined to be the maximum dimension perpendicularly from the first flat front area 19 to a bottom of the first downward body 4 along the axial length of the main tubular body 11. As shown in FIGS. 4 and 8, the non-circular cross-section includes a first non-circular cross-section 43 which is located in a range from a position within 30% of the overall length of the golf putter grip A to a position which is one inch (including one inch that is 25.4 mm) from the bottom open end 31, and a second non-circular cross-section 42 which is towards a position within one inch (25.4 mm) from the top end 21.

Referring again to FIGS. 4, 5, and 6, the first non-circular cross-section 43 has a depth dimension D14 from the first flat front area 19 to a bottom point 44 of the first downward body 4 at the position of the imaginary bottom edge 14 and is bisected by a hypothetical line formed by the central mark 17 and an axis point X14 of the axis X of the cavity 3 (FIG. 6). The second non-circular cross-section 42 has a depth dimension D13 from the first flat front area 19 to another bottom point 45 of the first downward body 4 at the position of the top edge 13 and is bisected by another hypothetical line formed by the central mark 18 and another axis point X13 of the axis X of the cavity 3 (FIG. 5). The axis X of the cavity 3 is preferable to be parallel to the central line formed by the two central marks 17 and 18 (FIG. 8).

The depth dimension D14 of the first non-circular cross-section 43 is from 44.45 mm to 30 mm and is the longest depth dimension in the non-circular cross-section of the main tubular body 11. The depth dimension D13 of the second non-circular cross-section 42 is from 39.69 mm to 23.09 mm and is the shortest depth dimension in the non-circular cross-section of the main tubular body 11. The depth dimension D14 of the first non-circular cross-section 43 is longer than the depth dimension D13 of the second non-circular cross-section 42 in a ratio of 1.12:1 to 1.75:1.

Figure 7:
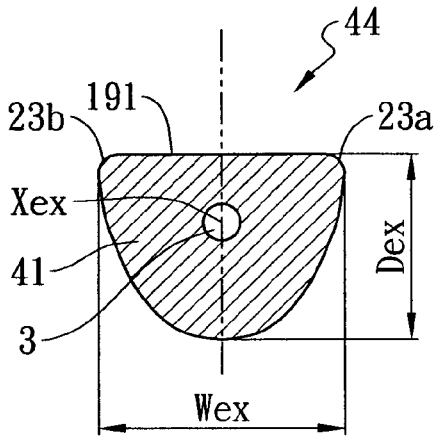
FIG. 7 is a cross sectional view showing a third non-circular cross-section of a hollow lower portion in the first embodiment of the present invention taken on line 7-7 of FIG. 4.

Referring to FIGS. 4, 7, and 8, the hollow lower portion 12 (another portion of the tubular body 1) is extended from the hypothetical (or imaginary) bottom edge 14. It comprises a second flat front area 191 extended from the bottom edge 14 of the first flat front area 19 of the main tubular body 11 to a position within one inch (25.4 mm) from the bottom open end 31, a non-reversely-tapered body shape towards the bottom open end 31, a third cross-section 44, and a second downward body 41 extended from the first downward body 4. The non-reversely-tapered body shape can be in a constant shape or other equivalent kinds of non-reversely-tapered shapes.

In the first embodiment (golf putter grip A), the hollow lower portion 12 prefers to have a constant cross-sectional shape being the same in shape and/or dimension to the bottom open end 31 (FIG. 4). Its third cross-section 44 has a width dimension Wex and depth dimension Dex which are respectively the same with the width dimension W and the depth dimension D14 of the first non-circular cross-section 43 (FIGS. 6 and 7). Its second downward body 41 is connected with the second flat front area 191 by means of a pair of curves 23*a*, 23*b* forming smoothly rounded shoulders along the axial length of the hollow lower portion 12.

As what is stated above, the golf putter grip A's main tubular body 11 has a flat-topped arch cross-section. Its non-circular cross-section is symmetrical and remains similar throughout the axial length of the main tubular body 11 and the depth dimension D14 of the first non-circular cross-section 43 is longer than the depth dimension D13 of the second non-circular cross-section 42 in a ratio of 1.12:1 to 1.75:1. Because of these features, the shape of the golf putter grip A's main tubular body 11 is reversely tapered from the top cap portion 2 towards the bottom open end 31 as shown in FIGS. 4 and 8. Its reverse taper is sufficient within certain degrees to accommodate the fingers (middle fingers MD and small fingers PK) with different finger lengths and conform to a certain degree to a hollow interior of two hands cupped together, so that the golf players can hold the golf putter grip A to make the pendulum-type putting stroke comfortably with less gripping pressure. The width dimension W of the non-circular cross-section of the main tubular body 11 is bigger in such a range from 44.45 mm to 29.63 mm. The first flat front area 19 is preferably in rectangular or trapezoid shape. Its top edge 13 is extended up to a position within one inch (25.4 mm) from the top end 21 and its bottom edge 14 is located in a range from a position which is within 30% of overall length of the golf putter grip A to a position which is one inch (including one inch that is 25.4 mm) from the bottom open end 31. The widest portion of the first flat front area 19 is in a width range from 42.45 mm to 20 mm. Because of these features, the golf putter grip A is bigger in size and has sufficient space for the golf players to cup their two hands together at the same height and to place two thumbs side by side on the first flat front area 19 to hold the golf putter grip A, so as to make the pendulum-type putting stroke comfortable with minimal wrist breaking-down. The non-circular cross-sectional dimensions, such as its width dimension W and depth dimensions D13, D14, are no more than 44.45 mm and conform to "the Rules of Golf" published by U.S.G.A. For some golf players to make pendulum-type putting stroke, two thumbs can be placed side by side on the first flat front area 19, index fingers DX can be stretched and rested on the hollow lower portion 12's second downward body 41 while other fingers (middle fingers MD and small fingers PK) can be placed around the first downward body 4. Therefore, the four objects of the present invention are accomplished by the shape disclosed in the first embodiment (the golf putter grip A).

Referring to FIGS. 9 to 14, a golf putter grip B in a second embodiment of the present invention is illustrated. The overall length of the golf putter grip B is in a range from 7 inches (177.8 mm) to 21 inches (533.4 mm). The overall length hereof is defined to be a length from a vent hole 62 to a bottom open end 71 of the golf putter grip B.

Figure 9:
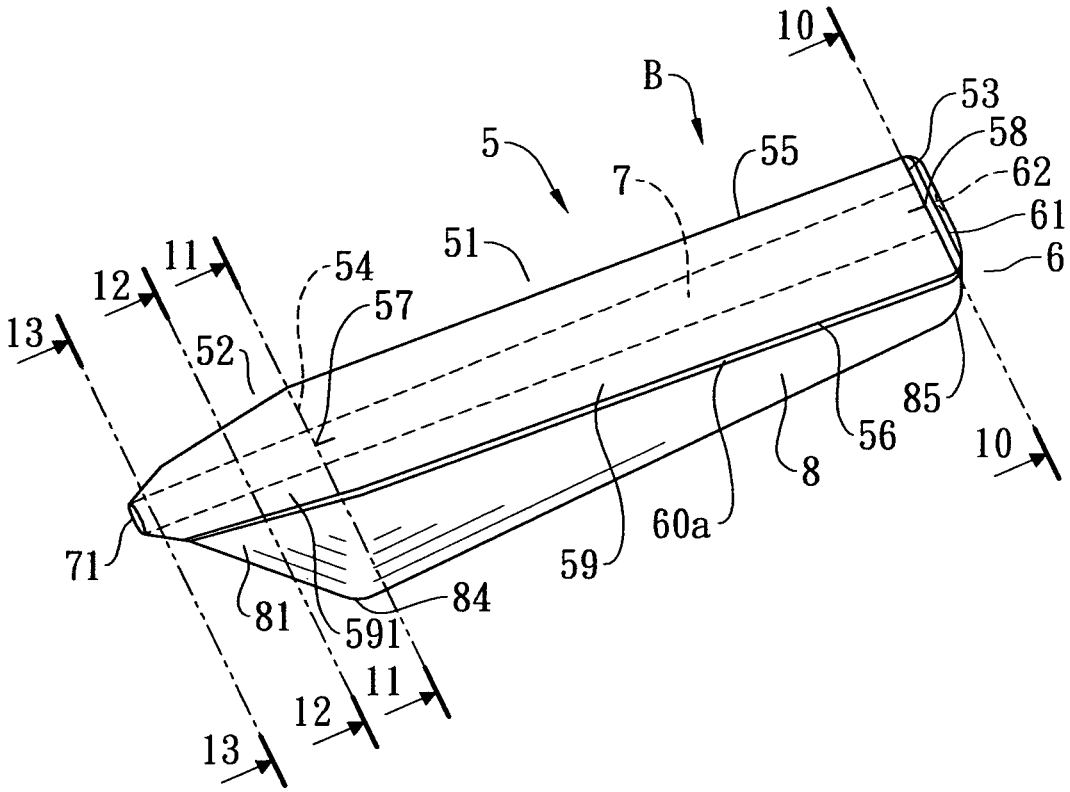
FIG. 9 is a perspective view showing a second embodiment of the present invention.
Figure 14:
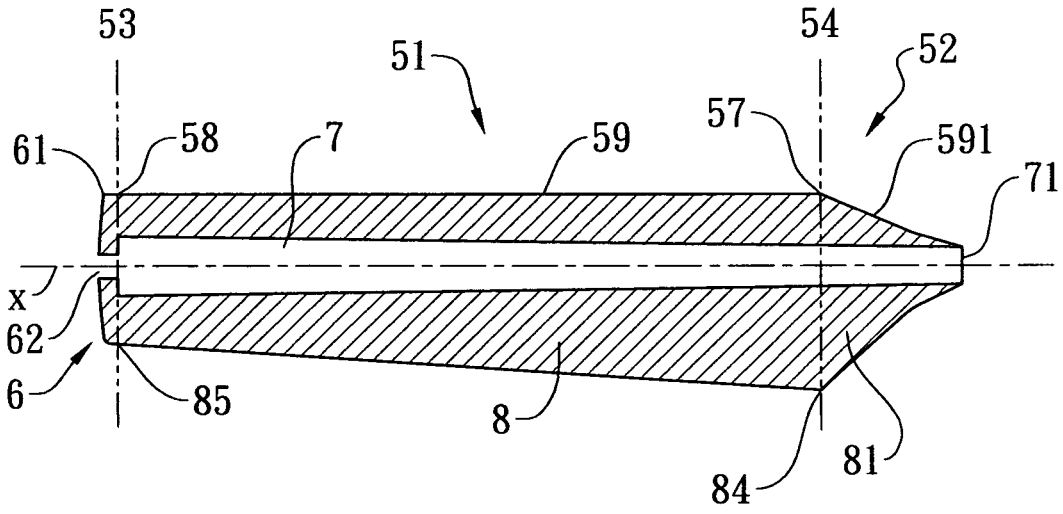
FIG. 14 is a longitudinal sectional view along a central part of the second embodiment of the present invention.

As shown in FIG. 9, it has a top cap portion 6, the bottom open end 71, and a tubular body 5 The top cap portion 6 has a top end 61 enclosed with the vent hole 62. The top end 61 hereof is defined to be an end at an upper edge of the top cap portion 6 close to the vent hole 62. If the top cap portion 6 has no upper edge and is curved in shape toward to the vent hole 62, then the edge of the vent hole 62 is the top end 61. The tubular body 5 extends from the top cap portion 6 to the bottom open end 71. A rear bigger end of a golf putter's shaft (not shown) can be inserted through the bottom open end 71 into the tubular body 5 up to the top cap portion 6 as shown in FIGS. 9 and 14.

The tubular body 5 has a main tubular body 51 and a hollow lower portion 52. The main tubular body 51 has a top edge 53 extended toward a position within one inch (25.4 mm) from the top end 61 and a hypothetical (or imaginary) bottom edge 54 located in a range from a position which is within 30% of the overall length of the golf putter grip B to a position which is one inch (including one inch that is 25.4 mm) from the bottom open end 71. The main tubular body 51 extends from the top cap portion 6 to the hollow lower portion 52.

Figure 10:
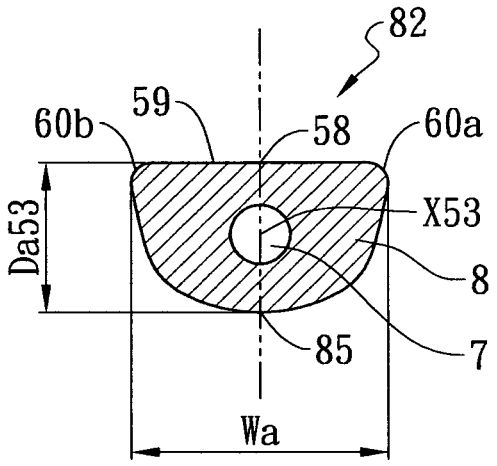
FIG. 10 is a cross sectional view showing a second non-circular cross-section of a main tubular body in the second embodiment of the present invention taken on line 10-10 of FIG. 9.
Figure 11:
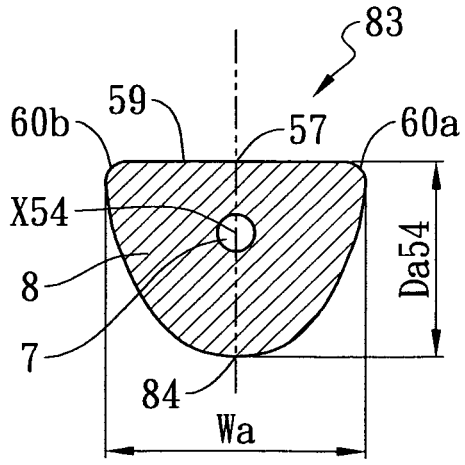
FIG. 11 is a cross sectional view showing a first non-circular cross-section of the main tubular body in the second embodiment of the present invention taken on line 11-11 of FIG. 9.

The main tubular body 51 further has a first flat front area 59 that is along and throughout an axial length of the main tubular body 51 and is between the top edge 53 and the hypothetical (or imaginary) bottom edge 54, a non-circular cross-section that is symmetrical and remains similar between the top cap portion 6 and the hollow lower portion 52 throughout the axial length of the main tubular body 51, and a first downward body 8 having a cavity 7 to envelope the rear bigger end of the golf putter's shaft (not shown). The size or dimension of the non-circular cross-section is gradually reduced from the hypothetical (or imaginary) bottom edge 54 to the top edge 53. As shown in FIGS. 9~11, the first downward body 8 is connected with the first flat front area 59 by means of a pair of curves 60*a*, 60*b* forming smoothly rounded shoulders along the axial length of the main tubular body 51.

When two hands are cupped together at the same height to hold the golf putter grip B for the pendulum-type putting stroke, two thumbs can be placed side by side on the first flat front area 59 and other fingers (besides index fingers DX) can be placed to hold around the first downward body 8.

Referring to FIG. 9, the first flat front area 59 prefers to be in a shape of trapezoid or rectangular, and more preferably in the rectangular shape. Its top edge 53 is extended up to a position within one inch (25.4 mm) from the top end 61 while its hypothetical (or imaginary) bottom edge 54 is located in a range from a position which is within 30% of the overall length of the golf putter grip B to a position which is one inch (including one inch that is 25.4 mm) from the bottom open end 71. A widest portion of the first flat front area 59 is in a width range from 42.45 mm to 20 mm and perpendicular to the axial length of the main tubular body 51. Its two edges 53,54 respectively interconnect to two axial edges 55, 56 and respectively have a central mark 58, 57. The two axial edges 55, 56 are equal in length.

The surface of the first flat front area 59 can be planar or slightly convex. It is preferably planar. The planar surface of the first flat front area 59 is helpful for the golf players or grip installers to ensure that the golf putter grip B is properly installed by positioning the planar surface of flat front area 59 to be perpendicular to a club head face of the golf putter.

Referring to FIGS. 10~11, the non-circular cross-section of the main tubular body 51 can be in triangular, rectangular, or flat-topped arch shape. It is preferably in flat-topped arch shape.

A non-circular cross-sectional width dimension Wa is defined to be the maximum dimension between the two outmost edges of the non-circular cross-section perpendicularly along the axial length of the main tubular body 51 and is in a range from 44.45 mm to 29.63 mm. A non-circular cross-sectional depth dimension is defined to be the maximum dimension perpendicularly from the first flat front area 59 to a bottom of the first downward body 8 along the axial length of the main tubular body 51.

As shown in FIGS. 9 and 14, the non-circular cross-section includes a first non-circular cross-section 83 that is located in a range from a position within 30% of the overall length of the golf putter grip B to a position which is one inch (including one inch which is 25.4 mm) from the bottom open end 71, and a second non-circular cross-section 82 that is towards a position within one inch (25.4 mm) from the top end 61.

Referring again to FIGS. 9~11, the first non-circular cross-section 83 has a depth dimension Da54 from the first flat front area 59 to a bottom point 84 of the first downward body 8 at the position of the hypothetical (or imaginary) bottom edge 54 and is bisected by a hypothetical line formed by the central mark 57 and an axis point X54 of the axis X of the cavity 7. The second non-circular cross-section 82 has a depth dimension Da53 from the first flat front area 59 to another bottom point 85 of the first downward body 8 at the position of the top edge 53 and is bisected by another hypothetical line formed by the central mark 58 and another axis point X53 of the axis X of the cavity 7. The axis X of the cavity 7 prefers to be parallel to the central line formed by the two central marks 57 and 58 (FIG. 14).

The depth dimension Da54 of the first non-circular cross-section 83 is from 44.45 mm to 30 mm and is the longest depth dimension in the non-circular cross-section of the main tubular body 51. The depth dimension Da53 of the second non-circular cross-section 82 is from 39.69 mm to 23.09 mm and is the shortest depth dimension in the non-circular cross-section of the main tubular body 51.

The depth dimension Da54 of the first non-circular cross-section 83 is longer than the depth dimension Da53 of the second non-circular cross-section 82 in a ratio of 1.12:1 to 1.75:1.

Figure 12:
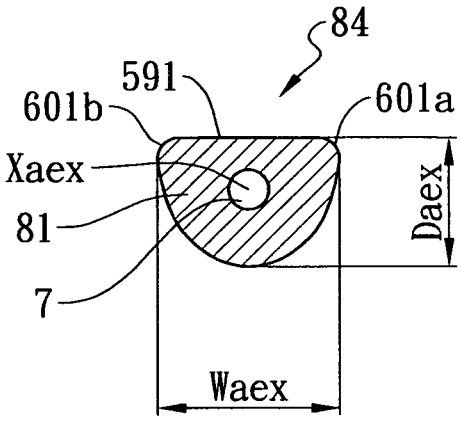
FIG. 12 is a cross sectional view showing a third non-circular cross-section of a hollow lower portion in the second embodiment of the present invention taken on line 12-12 of FIG. 9.
Figure 13:
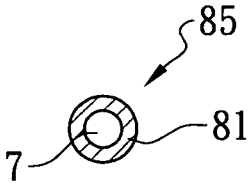
FIG. 13 illustrates a round shape cross-section of the hollow lower portion gradually closing to the bottom open end in the second embodiment of the present invention taken on line 13-13 of FIG. 9.

Referring to FIGS. 9, 12, and 14, the hollow lower portion 52 (another portion of the tubular body 5) is extended from the hypothetical (or imaginary) bottom edge 54. It comprises a second flat front area 591 extended from bottom edge 54 of the first flat front area 59 of the main tubular body 51 to a position within one inch (25.4 mm) from the bottom open end 71, a tapered body shape towards the bottom open end 71, a third cross-section 84, and a second downward body 81 extended from the first downward body 8. The third cross-section 84 is similar and smaller in dimension than the first non-circular cross-section 83 (FIG. 12) and gradually becomes round shape (FIG. 13) towards the bottom open end 71 as shown in FIGS. 9 and 14.

The golf putter grip B's main tubular body 51 has a flat-topped arch cross-section. Its non-circular cross-section is symmetrical and remains similar throughout the axial length of the main tubular body 51 and its first non-circular cross-section 83 has longer depth dimension Da54 than the depth dimension Da53 of the second non-circular cross-section 82 in a ratio of 1.12:1 to 1.75:1. Because of these features, the golf putter grip B's main tubular body 51 is reversely tapered from the top cap portion 6 towards the bottom open end 71 as shown in FIGS. 9 and 14. Its reverse taper is sufficient within certain degrees to accommodate the fingers (middle fingers MD and small fingers PK) with different finger lengths and conform to a certain degree to a hollow interior of two hands cupped together, so that the golf players can comfortably hold the golf putter grip B to make the pendulum-type putting stroke with less gripping pressure. The width dimension Wa of the non-circular cross-section of the main tubular body 51 is bigger in such a range from 44.45 mm to 29.63 mm. The first flat front area 59 is preferably in rectangular or trapezoid shape. Its top edge 53 is extended up to a position within one inch (25.4 mm) from the top end 61 while its hypothetical (or imaginary) bottom edge 54 is located in a range from a position within 30% of overall length of the golf putter grip B to a position which is one inch (including one inch that is 25.4 mm) from the bottom open end 71. The widest portion of the first flat front area 59 is in a width range from 42.45 mm to 20 mm. Because of these features, the golf putter grip B is bigger in size and has sufficient space for the golf players to cup their two hands together at the same height and to place two thumbs side by side on the first flat front area 59 to make the pendulum-type putting stroke comfortable with minimal wrist breaking-down. The non-circular cross-sectional dimensions, such as its width dimension Wa and depth dimensions Da53, Da54, are no more than 44.45 mm in order to conform to "the Rules of Golf" published by U.S.G.A. For some golf player's pendulum-type putting stroke, two thumbs can be placed side by side on the first flat front area 59, index fingers can be stretched and rested on the hollow lower portion 52's second downward body 81, and other fingers (middle fingers MD and small fingers PK) can hold around the first downward body 8. Therefore, the four objects of the present invention are accomplished by the shape of the second embodiment (the golf putter grip B).

The most practical and preferred embodiments according to the present invention are disclosed above. It should be understood that this invention is not limited to the disclosed embodiments but is intended to cover various arrangements included within the spirit and scope of the broadest interpretation so as to encompass all such modifications and equivalent arrangements.

We claim:

1. A golf putter grip, comprising:

a top cap portion, a bottom open end, a main tubular body extended between the top cap portion and the bottom open end, a hollow lower portion extended from said main tubular body to the bottom open end, and an overall length;

wherein the top cap portion has a top end and a vent hole;

wherein the overall length of the golf putter grip is defined to be the length from the vent hole to the bottom open end;

wherein said main tubular body has:

a cavity to receive a golf shaft;

a non-circular cross-section being symmetrical throughout an axial length of said main tubular body, where said non-circular cross-section has a width dimension defined to be the maximum dimension between the outmost edges of said non-circular cross-section and perpendicularly along the axial length of said main tubular body, and said width dimension is within a range from 44.45 mm to 29.63 mm; and a first flat front area having a top edge extended to a position within one inch (25.4 mm) from the top end of the top cap portion, a bottom edge located in a range from a position which is within 30% of the overall length of the golf putter grip to a position which is one inch (25.4 mm) from the bottom open end;

wherein said non-circular cross-section has a depth dimension defined to be the maximum dimension perpendicularly from the first flat front area to a bottom of said non-circular cross-section along the axial length of said main tubular body, and said depth dimension is in a range from 44.45 mm to 23.09 mm;

wherein said main tubular body is reversely tapered from the top cap portion towards the bottom open end;

wherein said non-circular cross-section includes a first non-circular cross-section and a second non-circular cross-section; the first non-circular cross-section has a depth dimension that is the longest depth dimension in said main tubular body and is located in a range from a position which is within 30% of the overall length of the golf putter grip to a position which is one inch (25.4 mm) from the bottom open end; the second non-circular cross-section has a depth dimension that is the shortest depth dimension in said main tubular body and is towards a position within one inch (25.4 mm) from the top end;

wherein the depth dimension of the first non-circular cross-section is longer than the depth dimension of the second non-circular cross-section in a ratio of 1.12:1 to 1.75:1;

wherein the hollow lower portion has:

a second flat front area extended from the bottom edge of the first flat front area of said main tubular body towards a position within one inch (25.4 mm) from the bottom open end; and a non-reversely-tapered body shape extended from said main tubular body to the bottom open end.

2. The golf putter grip as claimed in claim 1, the overall length of the golf putter grip is in a range from 7 inches (177.8 mm) to 21 inches (533.4 mm).

3. The golf putter grip as claimed in claim 1, wherein the first flat front area has a widest portion with a width dimension in a range from 42.45 mm to 20 mm and said widest portion is perpendicular to the axial length of said main tubular body.

4. The golf putter grip as claimed in claim 1, wherein the first flat front area is in a rectangular shape for golf players to place two thumbs side by side on the first flat front area comfortably.

5. The golf putter grip as claimed in claim 4, wherein the first flat front area is planar, whereby it is able to enhance the golf putter grip being installed properly with the first flat front area perpendicularly to a club head face of a golf putter.

6. The golf putter grip as claimed in claim 1, wherein said non-circular cross-section is in a flat-topped arch shape for golf players to cup two hands together at the same height and place two thumbs side by side on the first flat front area to hold the golf putter grip comfortably.

7. The golf putter grip as claimed in claim 1, wherein said main tubular body has a downward body connected with the first flat front area by means of a pair of curves forming smoothly rounded shoulders along the axial length of said main tubular body.

8. The golf putter grip as claimed in claim 1, wherein the hollow lower portion has a constant cross-sectional shape from said main tubular body to the bottom open end, whereby the golf players are able to stretch and rest their index fingers on the hollow lower portion for their pendulum-type putting stroke.

9. The golf putter grip as claimed in claim 1, wherein the hollow lower portion extended and tapered from said main tubular body to the bottom open end, whereby the golf players are able to stretch and rest their index fingers on the hollow lower portion for their pendulum-type putting stroke.

10. The golf putter grip as claimed in claim 1, wherein the cavity has an axis parallel to a central line of the first flat front area.

* * * * *